US010288071B2

(12) United States Patent
Le et al.

(10) Patent No.: US 10,288,071 B2
(45) **Date of Patent: *May 14, 2019**

(54) BEARING AND SHAFT ASSEMBLY FOR JET ASSEMBLIES

(71) Applicants: Kevin Le, Richland Hills, TX (US); Thanh Le, Grand Prairie, TX (US)

(72) Inventors: Kevin Le, Richland Hills, TX (US); Thanh Le, Grand Prairie, TX (US)

(73) Assignee: Luraco, Inc., Arlington, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/854,767

(22) Filed: Dec. 27, 2017

(65) Prior Publication Data

US 2018/0128273 A1 May 10, 2018

Related U.S. Application Data

(63) Continuation of application No. 15/854,747, filed on Dec. 26, 2017, now Pat. No. 10,215,178, which is a (Continued)

(51) Int. Cl.
*A61H 33/00* (2006.01)
*F04D 13/02* (2006.01)

(Continued)

(52) U.S. Cl.
CPC ..... *F04D 13/024* (2013.01); *F04D 13/026* (2013.01); *F04D 13/0633* (2013.01);

(Continued)

(58) Field of Classification Search
CPC .. F04D 13/026; F04D 13/024; F04D 13/0633; F04D 13/064; F04D 29/0465;

(Continued)

(56) References Cited

U.S. PATENT DOCUMENTS 2,506,886 A 5/1950 Okulitch et al.
2,545,422 A 3/1951 Blom (Continued)

FOREIGN PATENT DOCUMENTS

CA 1286755 C 7/1991
CN 203396450 U 1/2014

(Continued)

OTHER PUBLICATIONS

ANS Gspa F Pedicure Spa (http://buynailsdirect.com/nails-salon-pedicure-spas/glass-sink-spas/ans-gspa-f-pedicure-spa.html), Aug. 15, 2016.

(Continued)

*Primary Examiner* — Nathan C Zollinger
(74) *Attorney, Agent, or Firm* — Hoang Steve Ngo

(57) ABSTRACT

An improved bearing and shaft assembly includes a bearing assembly having an outer bearing member and an inner bearing member, and a shaft assembly having a shaft member, a shaft protection member, and a locking mechanism. The outer bearing member has a cavity for receiving the inner bearing member, and fits within a cavity of an impeller. The shaft assembly is secured within a housing of a jet assembly. The shaft protection member has a cavity for receiving the shaft member. The shaft protection member fits within the cavity of the inner bearing member. Also, a jet assembly, which includes the improved bearing and shaft assembly, may be coupled to a motor assembly. The jet assembly further includes the housing that includes at least one inlet aperture and at least one outlet aperture, and an impeller positioned within a cavity of the housing.

30 Claims, 9 Drawing Sheets

Related U.S. Application Data continuation of application No. 13/923,364, filed on Jun. 20, 2013, now Pat. No. 9,926,933.

(51) Int. Cl.

| | |
|---|---|
| ***F04D 13/06*** | (2006.01) |
| ***F04D 25/02*** | (2006.01) |
| ***F04D 25/06*** | (2006.01) |
| ***F04D 29/046*** | (2006.01) |
| ***F04D 29/047*** | (2006.01) |

(52) U.S. Cl.

CPC ..... *F04D 25/026* (2013.01); *F04D 29/047* (2013.01); *F04D 29/0465* (2013.01); *A61H 33/0087* (2013.01); *F04D 13/064* (2013.01); *F04D 25/06* (2013.01)

(58) Field of Classification Search

CPC ..... F04D 29/047; F04D 25/06; F04D 25/026; A61H 33/087

USPC ..... 417/420

See application file for complete search history.

(56) References Cited

U.S. PATENT DOCUMENTS

| | | | | | |
|---|---|---|---|---|---|
| 2,951,689 | A | | 9/1960 | Asp et al. | |
| 2,958,517 | A | | 11/1960 | Harker et al. | |
| 3,089,514 | A | * | 5/1963 | Sudmeier | F16L 55/00 137/563 |
| 3,198,125 | A | * | 8/1965 | Yuza | H02K 49/108 310/104 |
| 3,299,819 | A | | 1/1967 | McCoy | |
| 3,411,450 | A | | 11/1968 | Clifton | |
| 3,572,651 | A | | 3/1971 | Harker | |
| 3,630,645 | A | | 12/1971 | Eheim | |
| 3,932,068 | A | | 1/1976 | Zimmermann | |
| 3,941,517 | A | | 3/1976 | Miyahara | |
| 4,082,380 | A | | 4/1978 | Klaus et al. | |
| 4,115,040 | A | | 9/1978 | Knorr | |
| 4,135,863 | A | | 1/1979 | Davis et al. | |
| 4,226,574 | A | * | 10/1980 | Villette | F04D 7/06 310/104 |
| 4,304,532 | A | | 12/1981 | McCoy | |
| 4,312,752 | A | | 1/1982 | Malik | |
| 4,331,496 | A | * | 5/1982 | Orndorff, Jr. | B29C 70/08 156/187 |
| 4,513,735 | A | | 4/1985 | Friedson et al. | |
| 4,523,580 | A | | 6/1985 | Tureaud | |
| 4,569,337 | A | | 2/1986 | Baumann et al. | |
| 4,606,698 | A | | 8/1986 | Clausen et al. | |
| 4,716,605 | A | | 1/1988 | Shepherd et al. | |
| 4,875,497 | A | | 10/1989 | Worthington | |
| 4,982,606 | A | | 1/1991 | Adamski et al. | |
| 5,145,323 | A | | 9/1992 | Farr | |
| 5,238,369 | A | | 8/1993 | Farr | |
| 5,245,221 | A | | 9/1993 | Schmidt et al. | |
| 5,414,878 | A | | 5/1995 | Booth | |
| 5,458,459 | A | | 10/1995 | Hubbard et al. | |
| 5,587,023 | A | | 12/1996 | Booth | |
| 5,980,112 | A | * | 11/1999 | Matthews | F16C 17/14 384/275 |
| 5,992,447 | A | | 11/1999 | Miller et al. | |
| 6,732,387 | B1 | | 5/2004 | Waldron | |
| 6,997,688 | B1 | | 2/2006 | Klein et al. | |
| 7,108,202 | B1 | | 9/2006 | Chang | |
| 7,111,334 | B2 | | 9/2006 | Chen | |
| 7,168,107 | B2 | | 1/2007 | Gruenwald | |
| 7,393,188 | B2 | | 7/2008 | Lawyer et al. | |
| 7,432,725 | B2 | | 10/2008 | Sieh et al. | |
| 7,440,820 | B2 | | 10/2008 | Gougerot et al. | |
| 7,574,756 | B2 | | 8/2009 | Tran | |
| 7,593,789 | B2 | | 9/2009 | Gougerot et al. | |
| 8,214,937 | B2 | | 7/2012 | Lawyer et al. | |
| 8,296,874 | B2 | | 10/2012 | Galati, Jr. et al. | |
| 8,380,355 | B2 | | 2/2013 | Mayleben | |
| 8,531,048 | B2 | | 9/2013 | Tran et al. | |
| 8,657,583 | B2 | | 2/2014 | Ward | |
| 8,662,848 | B2 | | 3/2014 | Tran | |
| 8,936,444 | B2 | | 1/2015 | Drechsel et al. | |
| 8,944,786 | B1 | | 2/2015 | McDougall | |
| 9,220,657 | B2 | | 12/2015 | Stauber et al. | |
| 9,450,475 | B2 | | 9/2016 | Zumstein | |
| 9,551,343 | B2 | * | 1/2017 | Marks | A01K 63/047 |
| 9,572,747 | B2 | | 2/2017 | Tran et al. | |
| 9,926,933 | B2 | * | 3/2018 | Le | F04D 29/0465 |
| 2005/0045621 | A1 | | 3/2005 | Chenier et al. | |
| 2005/0262627 | A1 | | 12/2005 | Chen | |
| 2006/0096021 | A1 | | 5/2006 | Hutchings | |
| 2007/0101489 | A1 | | 5/2007 | Hutchings | |
| 2008/0035427 | A1 | | 2/2008 | Fowler | |
| 2008/0229819 | A1 | | 9/2008 | Mayleben et al. | |
| 2009/0064406 | A1 | | 3/2009 | Lawyer et al. | |
| 2009/0094736 | A1 | | 4/2009 | Booth et al. | |
| 2010/0074777 | A1 | | 3/2010 | Laufer et al. | |
| 2010/0239435 | A1 | | 9/2010 | Le et al. | |
| 2011/0004994 | A1 | | 1/2011 | Le et al. | |
| 2011/0116948 | A1 | | 5/2011 | Yi et al. | |
| 2011/0211982 | A1 | * | 9/2011 | Marks | A01K 63/047 417/420 |
| 2011/0223047 | A1 | | 9/2011 | Tran et al. | |
| 2011/0253236 | A1 | | 10/2011 | Le et al. | |
| 2011/0305562 | A1 | | 12/2011 | Matsunaga et al. | |
| 2012/0045352 | A1 | | 2/2012 | Lawyer et al. | |
| 2012/0156071 | A1 | | 6/2012 | Hijikata et al. | |
| 2013/0022481 | A1 | | 1/2013 | Schob et al. | |
| 2013/0263438 | A1 | | 10/2013 | Burns et al. | |
| 2015/0005682 | A1 | | 1/2015 | Danby | |
| 2015/0129039 | A1 | | 5/2015 | Mulvaney | |
| 2015/0227145 | A1 | | 8/2015 | Reddy et al. | |
| 2016/0097668 | A1 | | 4/2016 | Vilag | |

FOREIGN PATENT DOCUMENTS

| | | | | | |
|---|---|---|---|---|---|
| CN | 104897239 | A | | 9/2015 | |
| CN | 204758082 | U | | 11/2015 | |
| CN | 105592834 | A | | 5/2016 | |
| EP | 0149132 | | | 5/1989 | |
| EP | 2676652 | | | 12/2013 | |
| EP | 2997950 | A2 | | 3/2016 | |
| GB | 805539 | A | * | 12/1958 | F16C 33/20 |
| GB | 2156218 | A | | 10/1985 | |
| JP | H0678858 | | | 3/1994 | |
| JP | 2007263028 | A | | 10/2007 | |
| WO | WO2016059409 | A2 | | 4/2016 | |

OTHER PUBLICATIONS

Lexor Pedicure Spa User Manual (http://uspedicurespa.com/resources/lexor/luminous-spa-pedicure-chair-owner-manual.pdf), Aug. 15, 2016.

Maestro Pedicure Spa Owner's Manual (www.universalcompanies.com/FetchFile.ashx?id=c1571259-e567-4fcc-a079 . . . ), Aug. 15, 2016.

ANS Magnet Liner Jet (ALJ) Pedicure Spa Jet—Complete Set (http://buynailsdirect.com/ans-liner-jet-alj-pedicure-spa-jet-complete-set.html), Aug. 15, 2016.

Auto-Fill Sensor 2.15 (https://lexor.com/Store/Product/Auto-Fill-Sensor-2-15), Aug. 15, 2016.

SpaEquip User Manual (which contains the Sanijet Pipeless Hydrotherapy, Pipeless Whirlpool Foot Bath Owner's Manual for Model: FB2-S115), revised Sep. 2004.

Petra Collection Owner's Manual (which contains instructions for Sanijet—Pipeless System users), last updated Oct. 19, 2004, and copyright 2005.

Hanning document titled "Drain Pumps Synchronous Drain Pumps DPS/DPO," downloaded Aug. 24, 2016.

* cited by examiner

BEARING AND SHAFT ASSEMBLY FOR JET ASSEMBLIES

CROSS-REFERENCE TO RELATED APPLICATIONS

The present application is a continuation application of and claims the priority benefit of U.S. Nonprovisional patent application Ser. No. 15/854,747, filed Dec. 26, 2017, which is a continuation application of and claims the priority benefit of U.S. Nonprovisional patent application Ser. No. 13/923,364, filed Jun. 20, 2013, and now issued as U.S. Pat. No. 9,926,933 B2, which are incorporated herein by reference in their entirety.

BACKGROUND OF THE INVENTION

Field of the Invention

The present invention generally relates to spa devices, components, and systems. More specifically, the present invention is directed to an improved bearing and shaft assembly for jet assemblies, to a jet assembly that includes the improved bearing and shaft assembly, to a pump, such as a magnetic coupling-type pump, comprising a motor assembly and a jet assembly that includes the improved bearing and shaft assembly, and to a method for dispensing a fluid using the improved bearing and shaft assembly.

Description of the Related Art

Spa devices, components, and systems are known in the art. Spa devices are used in commercial and recreational settings for hydrotherapy, massage, stimulation, pedicure, and bathing purposes. Typical spa devices include a motor that drives a pump to circulate water from the spa device. In particular, a shaft of the motor is used to directly mount an impeller, which is then used to circulate water into and out of the spa device. Since the motor may not operate wet, a seal or a series of seals may be required to prevent water from entering the motor. The seals will wear to the point where water will enter the motor and consequently, the entering water may cause the motor to burn out. At this point, the motor assembly may be replaced in order to continue operation. This is expensive and may take several hours in which to perform.

Additionally, because typical spa devices have extensive piping systems that are built into the spa device to transport water, the spa devices are traditionally difficult to clean. This results in downtime and complicated maintenance schedules to clean such spa devices. Furthermore, if a spa device has a light source associated with it, to replace or repair such a light source can be time consuming and complicated when the light source is not easily accessible.

In the spa application environment, water is commonly added with certain substances and/or products, such as salt, chemicals, sand, massage lotions, etc. Due to this fact, traditional bearings, such as ball bearings and metal bushings, will not be suitable for a long term and reliable operation. The presence of chemicals and sand, for example, will cause some or many currently available bearings to wear out quicker than normal and result in pump failures.

In addition, for magnetic coupling-type pumps, it is almost impossible to have a perfect alignment between the motor shaft axis and the impeller rotation axis. The imperfect alignment or misalignment will result in high vibration noise.

The present invention overcomes one or more of the shortcomings of the above described spa devices, components, and systems. The Applicant is unaware of inventions or patents, taken either singly or in combination, which are seen to describe the present invention as claimed.

SUMMARY OF THE INVENTION

In one exemplary aspect, the present invention is directed to an improved bearing and shaft assembly for jet assemblies. The improved bearing and shaft assembly comprises a bearing assembly comprising an outer bearing member and an inner bearing member, and a shaft assembly comprising a shaft member, a shaft protection member, and a locking mechanism.

The outer bearing member preferably comprises a ring-like base and a cylindrical body extending upwardly from the ring-like base. The cylindrical body comprises a first end, a second end, and a cavity extending from the first end to the second end. The cavity is dimensioned and configured for receiving the inner bearing member. The outer bearing member is dimensioned and configured for fitting within a cavity of an impeller of a jet assembly.

The inner bearing member comprises a cylindrical body comprising a first end, a second end, and a cavity extending from the first end to the second end of the cylindrical body of the inner bearing member. The cavity of the cylindrical body of the inner bearing member is dimensioned and configured for receiving the shaft member and shaft protection member of the shaft assembly.

The shaft member comprises a base and a cylindrical body extending upwardly from the base of the shaft member. The cylindrical body of the shaft member comprises a first end and a second end. The shaft member is adapted for being secured within a housing of a jet assembly, such as the base of the shaft member being secured centrally within a cavity of the housing of the jet assembly.

The shaft protection member preferably comprises a ring-like base and a cylindrical body extending upwardly from the ring-like base of the shaft protection member. The cylindrical body of the shaft protection member comprises a first end, a second end, and a cavity extending from the first end to the second end of the cylindrical body of the shaft protection member. The cavity of the cylindrical body of the shaft protection member is dimensioned and configured for receiving the cylindrical body of the shaft member. The cylindrical body of the shaft protection member is dimensioned and configured for fitting within the cavity of the cylindrical body of the inner bearing member.

The locking mechanism secures or locks the shaft member and shaft protection member in place during operational use.

In another exemplary aspect, the present invention is directed to a jet assembly that includes the improved bearing and shaft assembly. In addition to the improved bearing and shaft assembly, the jet assembly further includes a housing defining a cavity and comprising at least one inlet aperture disposed about the housing and dimensioned and configured to receive a fluid and at least one outlet aperture disposed about the housing and dimensioned and configured to output the fluid, and an impeller positioned within the cavity defined by the housing and configured to rotate within the cavity when a magnetic pole array from a motor assembly is driven such that rotation of the impeller causes the fluid to flow into the inlet aperture and out the outlet aperture. The jet assembly is adapted for being coupled to a motor assembly.

In an additional exemplary aspect, the present invention is directed to a pump, such as a magnetic coupling-type pump, comprising a motor assembly and a jet assembly that includes the improved bearing and shaft assembly. The motor assembly has a motor and a magnetic pole array such that the motor is configured to drive the magnetic pole array. The jet assembly is secured or coupled to the motor assembly. In addition to the improved bearing and shaft assembly, the jet assembly further includes a housing defining a cavity and comprising at least one inlet aperture preferably disposed about the housing and dimensioned and configured to receive a fluid and at least one outlet aperture preferably disposed about the housing and dimensioned and configured to output the fluid, and an impeller positioned within the cavity defined by the housing and configured to rotate within the cavity when the magnetic pole array from the motor assembly is driven such that rotation of the impeller causes the fluid to flow into the inlet aperture and out the outlet aperture.

In a further exemplary aspect, the present invention is directed to a method for dispensing a fluid using the improved bearing and shaft assembly.

Figure 1A:
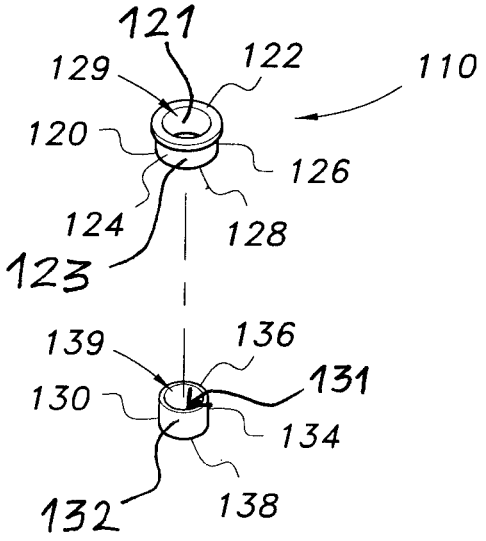
FIG. 1A is a perspective, exploded view of a bearing assembly of an improved bearing and shaft assembly according to the present invention.

It should be understood that the above-attached figures are not intended to limit the scope of the present invention in any way.

DETAILED DESCRIPTION OF THE PREFERRED EMBODIMENTS

Referring to FIGS. 1A-5 and in one exemplary aspect, the present invention is directed to an improved bearing and shaft assembly 100 for jet assemblies 180.

The improved bearing and shaft assembly 100 is comprised of a bearing assembly 110 comprising an outer bearing member 120 and an inner bearing member 130, and a shaft assembly 140 comprising a shaft member 150, a shaft protection member 160, and a locking mechanism 159.

Figure 1B:
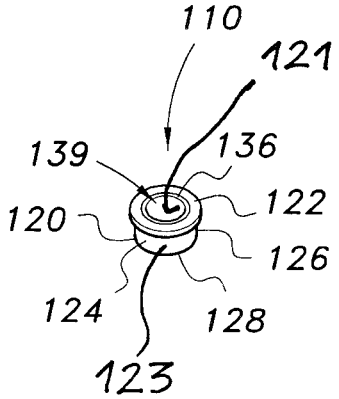
FIG. 1B is a perspective, assembly view of the bearing assembly of FIG. 1A.
Figure 2:
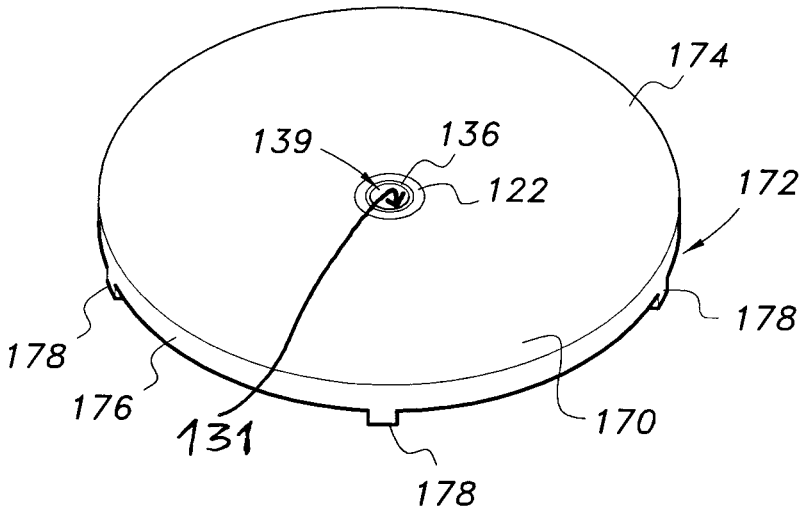
FIG. 2 is a perspective, assembly view of the bearing assembly of FIG. 1A positioned within a cavity of an impeller.

As shown in FIGS. 1A, 1B and 2, the outer bearing member 120 and inner bearing member 130 perform as a bearing. The inner bearing member 130 absorbs vibration and noise when in use with other components of a jet assembly 180 or a pump 300, such as a magnetic coupling-type pump 300 and the like.

Figure 5:
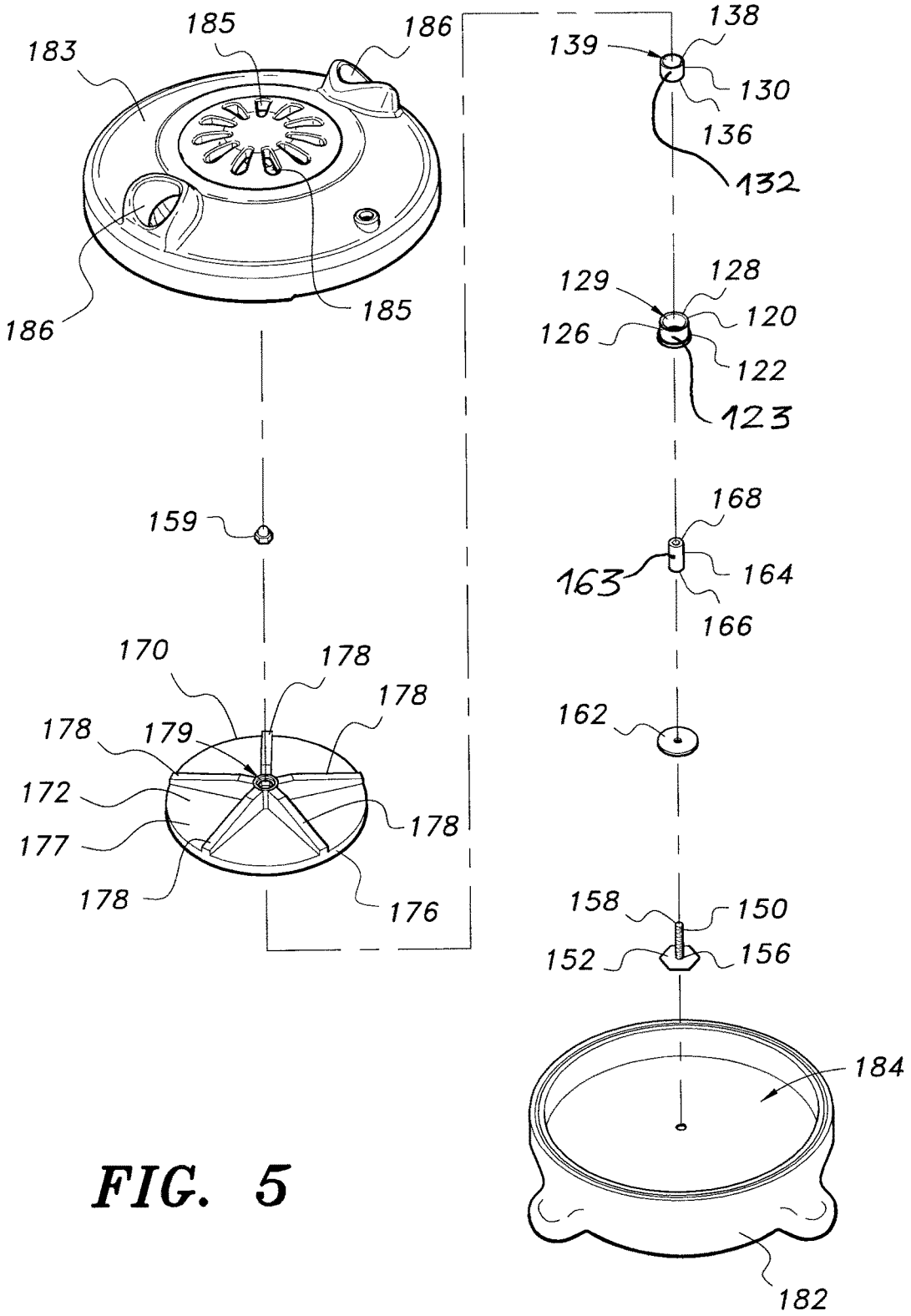
FIG. 5 is a perspective, exploded view of the bearing assembly of FIG. 1A, the shaft assembly of FIG. 3A, and a jet assembly (with a front cover)

The outer bearing member 120 includes an inner surface 121, an outer surface 123, a base 122, preferably a ring-like base, and a cylindrical body 124 extending upwardly from the ring-like base 122. The ring-like base 122 has a predetermined thickness. The cylindrical body 124 has a first end 126, a second end 128, and a cavity 129 extending from the first end 126 to the second end 128. As shown in FIGS. 1A, 1B, 2 and 5, the cavity 129 is dimensioned and configured for receiving the inner bearing member 130. Preferably, when in use, the outer bearing member 120 and inner bearing member 130 are closely or tightly positioned relative to one another such that they form an effective seal. As shown in FIGS. 2 and 5, the outer bearing member 120 is dimensioned and configured for fitting, preferably closely or tightly fitting, within a centrally-disposed cavity 179 of an impeller 170, preferably a magnetic impeller and more preferably a planar magnetic impeller, of a jet assembly 180. Preferably and as best shown in FIG. 2, the ring-like base 122 of the outer bearing member 120 and first end 136 of the cylindrical body 134 of the inner bearing member 130 are substantially flush with the rear side 174 of the magnetic impeller 170 when the outer bearing member 120 and inner bearing member 130 are positioned within the centrally-disposed cavity 179 of the magnetic impeller 170. Preferably, the centrally-disposed cavity 179 of the magnetic impeller 170 is dimensioned and configured for effectively receiving the bearing assembly 110 prior to use, and also for effectively retaining the bearing assembly 110 when in use. The outer bearing member 120 is preferably made or manufactured of a plastic material or engineered plastics. It is obvious to one of ordinary skill in the art that other suitable materials may be used in the making or manufacturing of the outer bearing member 120.

The inner bearing member 130 includes an inner surface 131, an outer surface 132, and a cylindrical body 134 having first end 136, a second end 138, and a cavity 139 extending from the first end 136 to the second end 138. As shown in FIGS. 1A, 1B, 2, 5, 9A and 9B, the inner surface 131 of the inner bearing member 130 is preferably generally smooth to work or operate in concert with the shaft protection member 160, which is preferably polished or super smooth on its outer surface 163. As shown in FIGS. 1A, 1B, 2 and 5, the cavity 139 is dimensioned and configured for receiving the shaft member 150 and shaft protection member 160 of the shaft assembly 140. The inner bearing member 130 is preferably made or manufactured of rubber or a rubber-like material. It is obvious to one of ordinary skill in the art that other suitable materials may be used in the making or manufacturing of the inner bearing member 130.

As shown in FIGS. 3A, 3B, 4 and 5, the shaft assembly 140 includes the shaft member 150, the shaft protection member 160, and the locking mechanism 159.

Figure 3A:
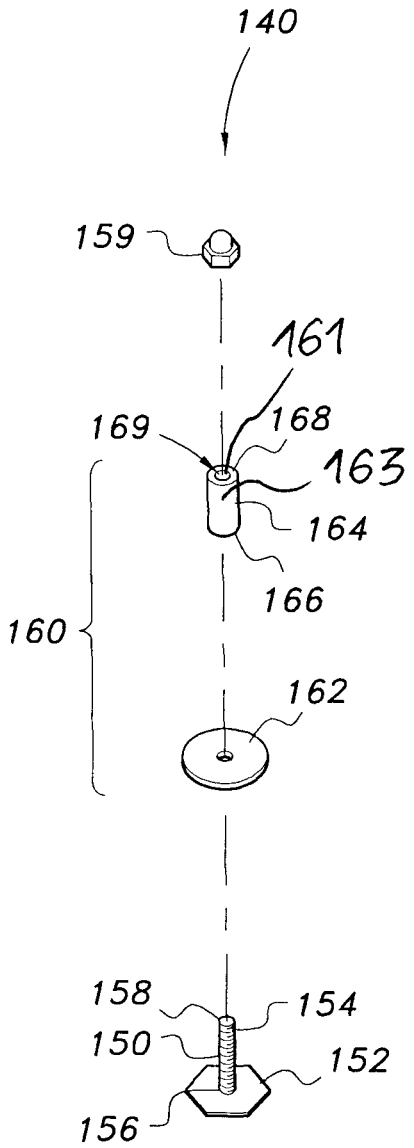
FIG. 3A is a perspective, exploded view of a shaft assembly of an improved bearing and shaft assembly according to the present invention.
Figure 3B:
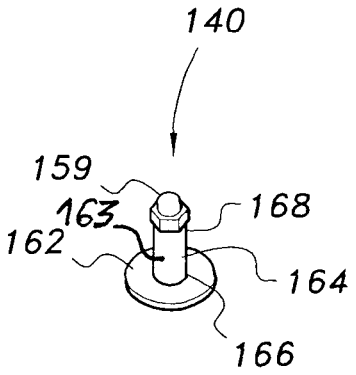
FIG. 3B is a perspective, assembly view of the shaft assembly of FIG. 3A.
Figure 4:
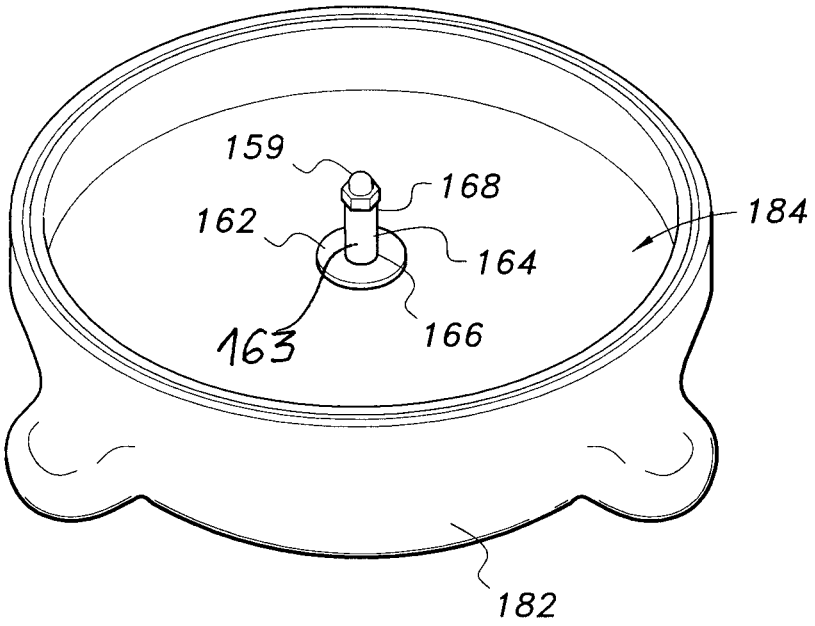
FIG. 4 is a perspective, assembly view of the shaft assembly of FIG. 3A positioned relative to a housing (without a front cover) of a jet assembly.

As shown in FIGS. 3A, 3B and 5, the shaft member 150 includes a base 152 and a cylindrical body 154 extending upwardly from the base 152. The cylindrical body 154 has a first end 156 and a second end 158. As best shown in FIG.

4, the shaft member 150 and shaft protection member 160 are secured within the housing 181, preferably in a central location within a cavity 184 of the housing 181, of the jet assembly 180 via the base 152 of the shaft member 150 being secured to the base 182 of the housing 181. The cylindrical body 154 has a first end 156 and a second end 158. The shaft member 150 is preferably made or manufactured of steel or a metal material. It is obvious to one of ordinary skill in the art that other suitable materials may be used in the making or manufacturing of the shaft member 150. Also, the shaft member 150 is preferably made or manufactured as a single piece. It is obvious to one of ordinary skill in the art that the shaft member 150 may be made or manufactured as multiple pieces.

The shaft protection member 160 includes an inner surface 161, an outer surface 163, a base 162, preferably a ring-like base, and a cylindrical body 164 extending upwardly from the ring-like base 162. The cylindrical body 164 has a first end 166, a second end 168, and a cavity 169 extending from the first end 166 to the second end 168. As shown in FIG. 3B, the cavity 169 is dimensioned and configured for receiving the cylindrical body 154 of the shaft member 150. The shaft protection member 160 is preferably made or manufactured of a hard material, such as ceramic or a ceramic-type material. It is obvious to one of ordinary skill in the art that other suitable materials may be used in the making or manufacturing of the shaft protection member 160. Also, the shaft protection member 160 is preferably polished or super smooth on its outer surface 163. Further, the shaft protection member 160 is preferably made or manufactured as two pieces. It is obvious to one of ordinary skill in the art that the shaft protection member 160 may be made or manufactured as a single piece.

As shown by FIGS. 3A, 3B, 4-6, 9A and 9B and when in use, the locking mechanism 159 secures or locks the shaft member 150 and shaft protection member 160 in place during operational use. The locking mechanism 159 may be a locking nut that, when in use, is secured onto the second end 158 of the cylindrical body 154 of the shaft member 150.

Figure 6:
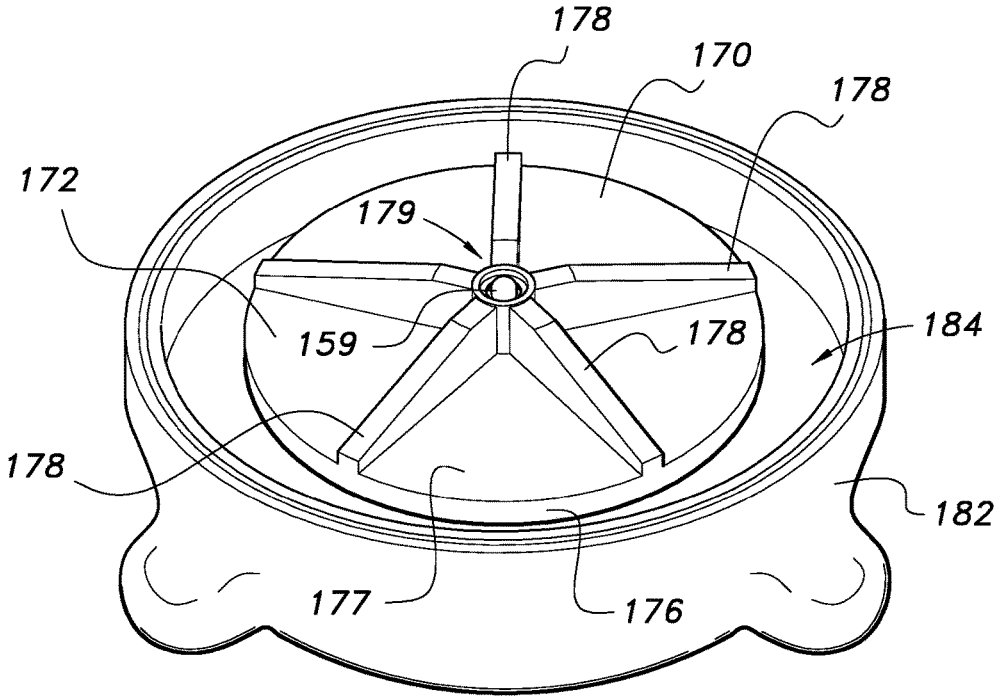
FIG. 6 is a perspective, assembly view of the improved bearing and shaft assembly of FIGS. 1A and 3A, and the impeller and housing of the jet assembly (without the front cover) of FIG. 5.
Figure 7:
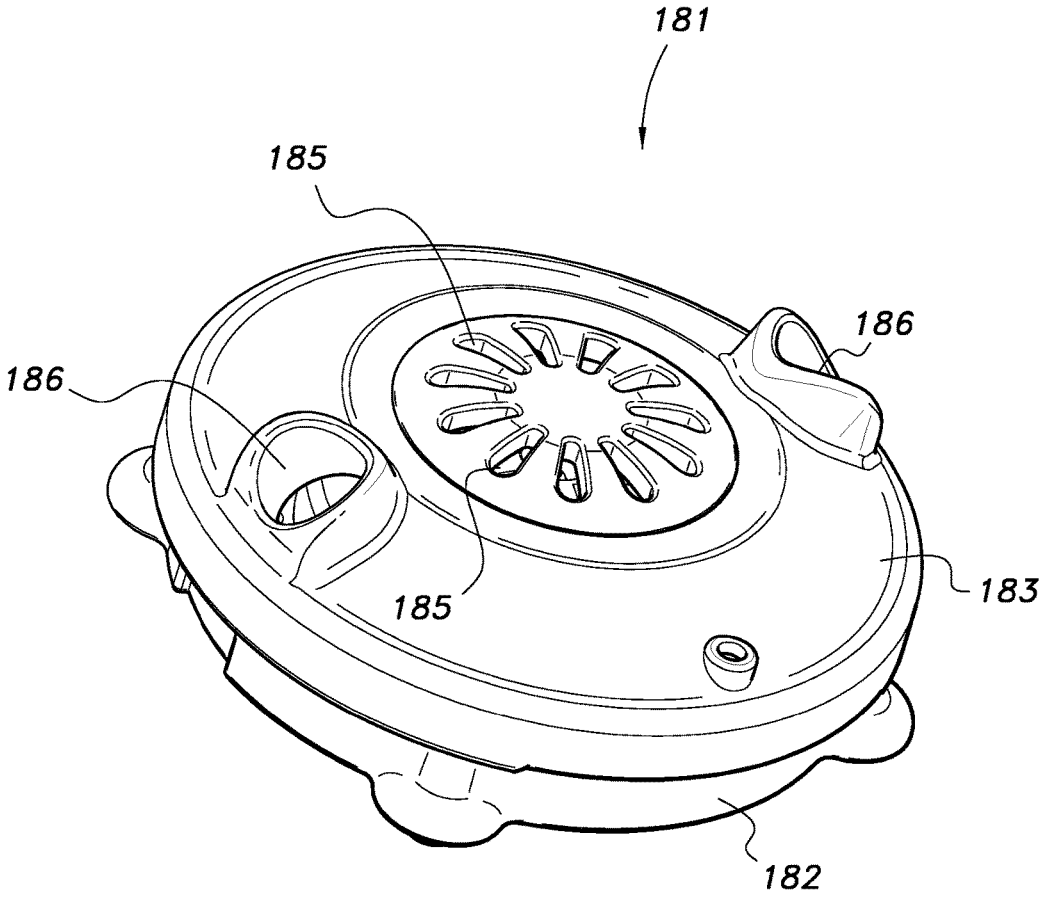
FIG. 7 is a perspective, assembly view of the improved bearing and shaft assembly of FIGS. 1A and 3A, and the impeller and housing of the jet assembly (with the front cover) of FIG. 5.

As shown in FIGS. 2, 5 and 6, the magnetic impeller 170 has a "disc-like" configuration or shape, and includes a front side 172, a rear side 174, a sidewall 176, a circular array of arm members 178 positioned on the front side 172, and the centrally-disposed cavity 179 dimensioned and configured for receiving the outer bearing member 120, inner bearing member 130, shaft member 150, and shaft protection member 160. The centrally-disposed cavity 179 preferably extends from the front side 172 through to the rear side 174. The magnetic impeller 170 is configured to rotate about the shaft member 150 and shaft protection member 160. Preferably, the magnetic impeller 170 is formed in whole or in part of a magnetic pole array 177 that, as discussed below, interacts with magnetic pole array 210 of the motor assembly 200 to rotate the magnetic impeller 170 about the shaft member 150 and shaft protection member 160. As a non-limiting example, the magnetic impeller 170 may contain a magnetic plate within an exterior made or manufactured of rubber or a rubber-like material. It is obvious to one of ordinary skill in the art that the magnetic impeller 170 may be other types of magnetic impellers that is know in the art.

In use and as shown in FIGS. 4-6, 9A and 9B, the base 152 of the shaft member 150 and base 162 of the shaft protection member 160 may be secured preferably in a central location within the cavity 184 of the housing 181 of the jet assembly 180 of the magnetic coupling-type pump 300. The bearing assembly 110 may then be positioned in the cavity 179 of the magnetic impeller 170, which can then be positioned within the cavity 184 of the housing 181 of the jet assembly 180. The locking mechanism or nut 159 can then be secured to the second end 158 of the cylindrical body 154 of the shaft member 150 to secure or lock the shaft member 150 and shaft protection member 160 in place during operational use. As best shown FIGS. 9A and 9B, the base 162 of the shaft protection member 160 makes contact with the base 122 or first end of the outer bearing member 120 during operational use.

Referring to FIGS. 1A-7, in another exemplary aspect, the present invention is directed to a jet assembly 180 that includes the improved bearing and shaft assembly 100 (as described above). The jet assembly 180 is adapted for being secured or coupled to a motor assembly 200.

In addition to the improved bearing and shaft assembly 100, the jet assembly 180 further includes a housing 181 and an impeller 170 (as described above), preferably a magnetic impeller and more preferably a planar magnetic impeller.

As shown in FIGS. 4-7, the housing 181 of the jet assembly 180 includes a base 182, a front cover 183, the cavity 184 defined within the base 182 and front cover 183, at least one inlet aperture 185 dimensioned and configured to receive a fluid and preferably disposed on the front cover 183, and at least one outlet aperture 186 dimensioned and configured to output the fluid and preferably disposed on the front cover 183.

The magnetic impeller 170 is adapted for being positioned within the cavity 184 of the housing 181 and configured to rotate within the cavity 184 when a magnetic pole array 210 from the motor assembly 200 is driven such that rotation of the magnetic impeller 170 causes the fluid to flow into the inlet aperture 185 and out the outlet aperture 186.

Figure 8:
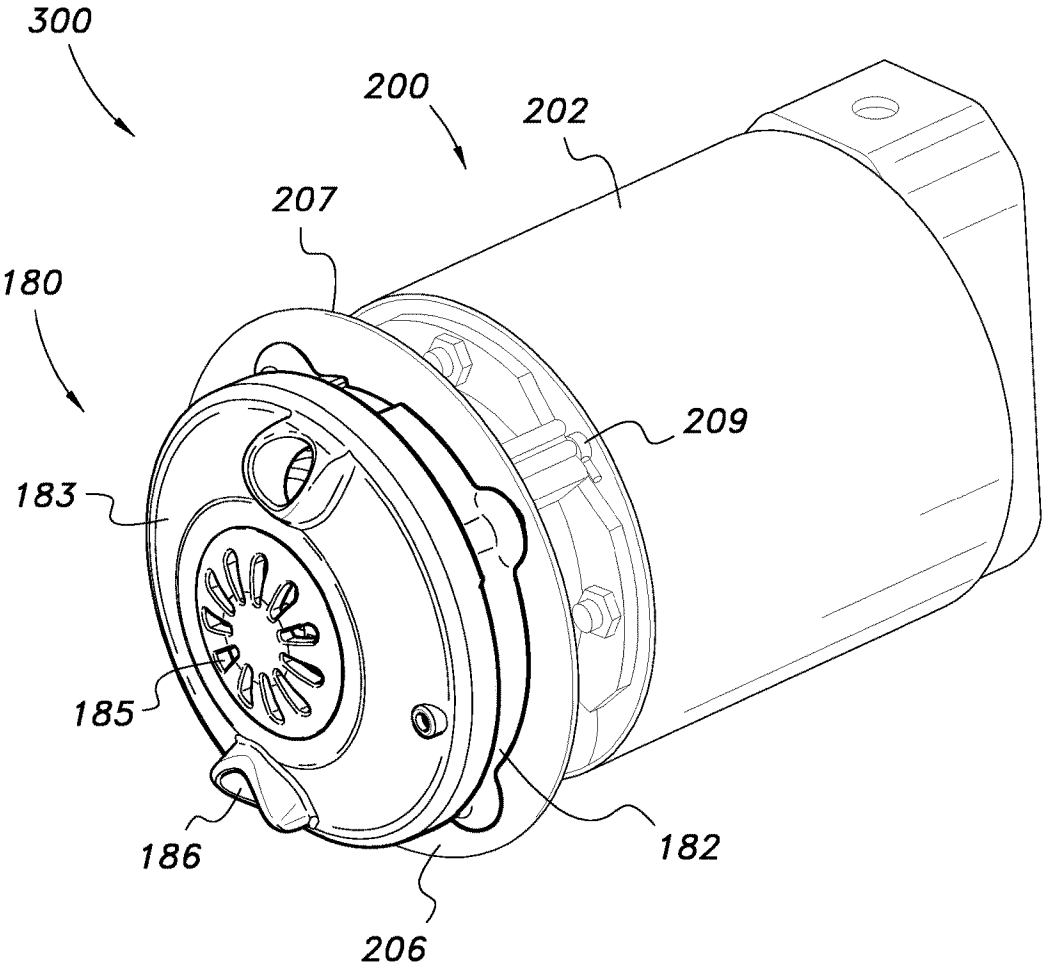
FIG. 8 is a perspective view of a magnetic coupling-type pump according to the present invention, showing a jet assembly and a motor assembly coupled to one another.
Figure 9A:
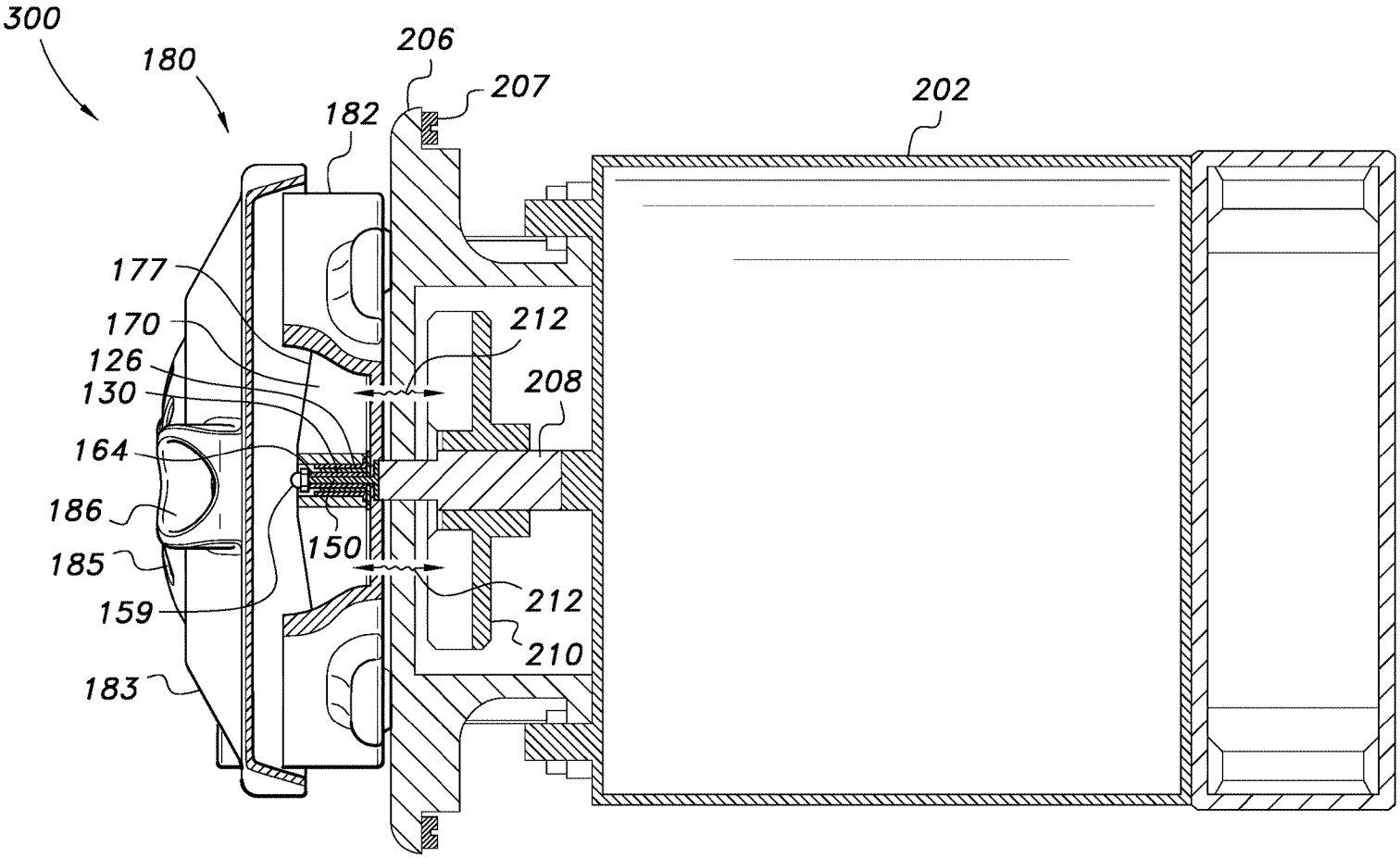
FIG. 9A is a cross-sectional view of the magnetic coupling-type pump of FIG. 8.
Figure 9B:
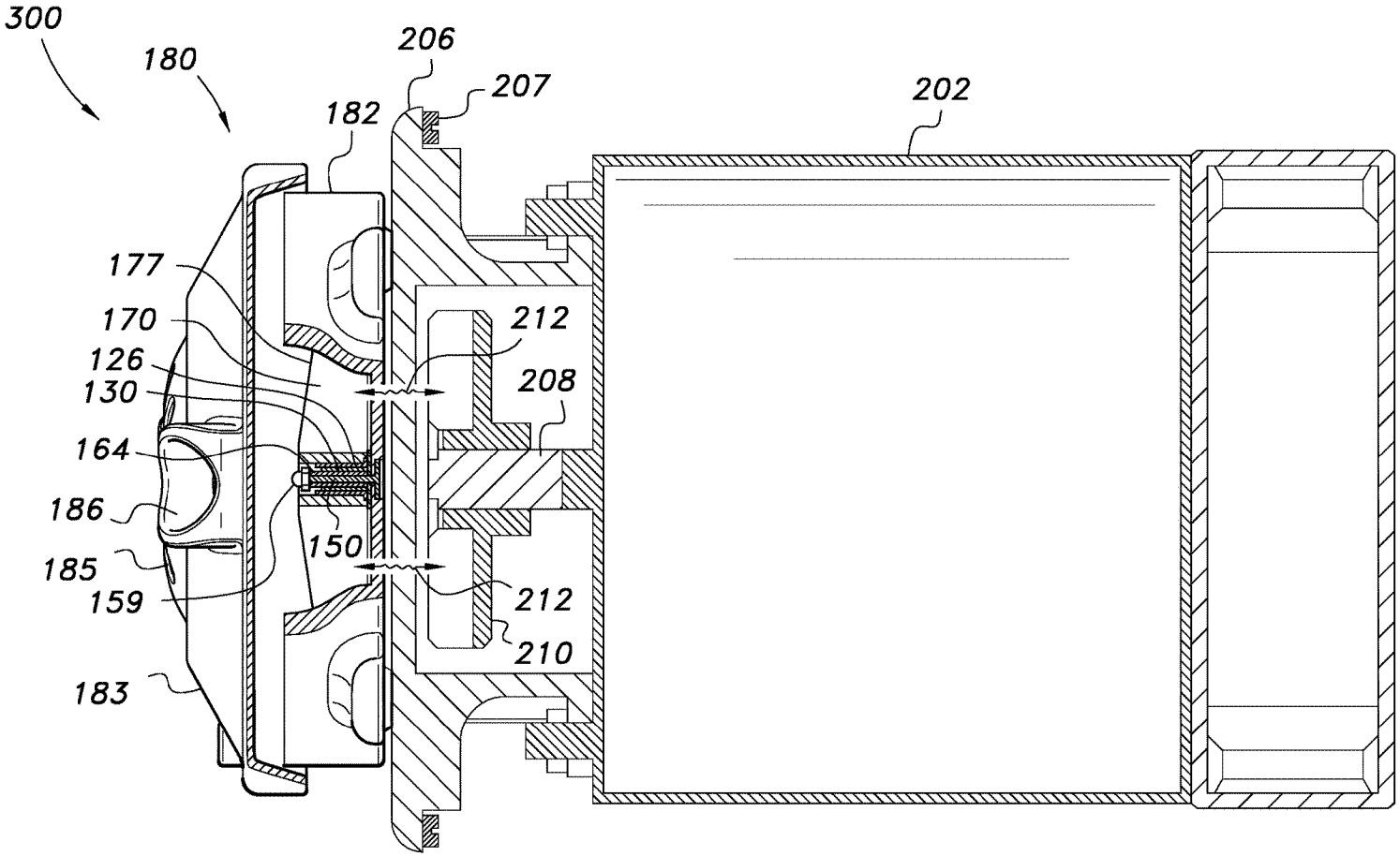
FIG. 9B is a cross-sectional view of another embodiment of a magnetic, coupling-type pump according to the present invention, showing a jet assembly and a motor assembly secured or coupled to or about one another.

Preferably when in use and as shown in FIGS. 8, 9A and 9B, the jet assembly 180 is positioned adjacent or in close proximity to the motor assembly 200 when the magnetic pump 300 is fully assembled. In that regard, the jet assembly 180 is preferably magnetically coupled to the motor assembly 200 when the jet assembly 180 is positioned adjacent or in close proximity to the motor assembly 200. Specially, the magnetic pole array 210 of the motor assembly 200 and the magnetic pole array 177 of the jet assembly 180 magnetically couple together the motor assembly 200 and the jet assembly 180.

Moreover, during operation of the motor assembly 200 as shown in FIGS. 9A-9B, the shaft member 150 of the shaft assembly 140 is stationary while the motor shaft member 208 is rotated such that the magnetic field 212 generated by the magnetic pole array 210 of the motor assembly 200 moves or fluctuates in accordance with the rotation of the magnetic pole array 210 of the motor assembly 200. This moving or fluctuating magnetic field 212 moves and/or causes rotation of magnetic pole array 177 of the magnetic impeller 170. Additionally, as discussed in greater detail below, rotation of the magnetic impeller 170 results in fluid being drawn towards the magnetic impeller 170 through inlet apertures 185 and such fluid to be propelled out of the jet assembly 180 through the outlet aperture 186.

Referring to FIGS. 1A-9B, in an additional exemplary aspect, the present invention is directed to a pump 300, preferably a magnetic coupling-type pump, comprising a motor assembly 200 and a jet assembly 180 (as described above) that includes the improved bearing and shaft assembly 100 (as described above). The jet assembly 180 is secured or coupled to the motor assembly 200.

As best shown in FIGS. 9A-9B, the motor assembly 200 includes a motor 202, a magnetic pole array 210 such that the motor 202 is configured to drive the magnetic pole array 210, a mounting housing member 206, a gasket 207, a motor shaft member 208 that is coupled to the magnetic pole array 210, and a plurality of screws with wing nuts 209 to support the pump mounting. The mounting housing member 206 and gasket 207 preferably enclose all or a substantial portion of the magnetic pole array 210, and help to keep fluids and/or substances away from the motor 202 and magnetic pole array 210 so that contamination and/or damage is reduced or prevented. The magnetic pole array 210 is formed of magnetic material and/or is magnetized in order to generate a magnetic field 212.

In that regard, the motor assembly 200 may include and/or be coupled to a power source (not shown) that enables rotation of the motor shaft member 208. Upon operation of the motor assembly 200, the motor shaft member 208 is rotated such that the magnetic field 212 generated by the magnetic pole array 210 moves or fluctuates in accordance with the rotation of the magnetic pole array 210.

In addition, when the magnetic coupling-type pump 300 is assembled, the jet assembly 180 is positioned adjacent or in close proximity to the mounting housing member 206 of the motor assembly 200. The jet assembly 180 is preferably magnetically coupled to the motor assembly 200 when the jet assembly 180 is positioned adjacent or in close proximity to the mounting housing member 206. The jet assembly 180 and mounting housing member 206 can be secured or coupled to one another by any method and/or device known to one of ordinary skill in the art.

Furthermore, the motor assembly 200 may further include an air channel (not shown), or air channel member (not shown). In that regard, the air channel includes an inlet (not shown) and outlet (not shown). The air channel, in part, enables the jet assembly 180 to produce a jet stream of fluid that includes an air mixture.

Additionally, the motor assembly 200 may further include sensors (not shown). The sensors may be positioned on a front facing surface (not shown), or annular flange, of the mounting housing member 206. The sensors may include electrodes that act as level sensors that sense the level of fluid around the pump 300. If the sensors detect that the level of fluid around the pump 300 is below a predetermined level or value, then the sensors can shut off the pump 300. For example, if pump 300 is being used in a spa application, the sensors can detect the level of fluid in a basin in which the pump 300 is being used. If the fluid level is too low such that continued operation of pump 300 may cause damage to the pump, then sensors send a signal to motor assembly 200 to stop the motor assembly 200 from operating. Therefore, the sensors act as a safety mechanism that prevents the pump 300 from burning out if fluid levels are too low for proper functioning of pump 300.

Although the sensors have been described as being associated with particular aspects of motor assembly 200, it is contemplated that sensors can be associated with other and/or additional portions of motor assembly 200. Additionally, in other embodiments sensors can be associated with jet assembly 180. Furthermore, in other embodiments sensors can be associated with both motor assembly 200 and jet assembly 180. Moreover, although two sensors are shown it is contemplated that one sensor or more than two sensors can be used to detect fluid levels around pump 300.

In a further exemplary aspect, the present invention is directed to a method for dispensing a fluid using an improved bearing and shaft assembly 100 for a jet assembly 180, the method comprising the steps of:

securing the improved bearing and shaft assembly 100 within a housing 181 of a jet assembly 180, wherein the improved bearing and shaft assembly 100 comprises a bearing assembly 110 and a shaft assembly 140, wherein the bearing assembly 110 comprises an outer bearing member 120 and an inner bearing member 130, wherein the shaft assembly 140 comprises a shaft member 150, a shaft protection member 160, and a locking mechanism 159, wherein the outer bearing member 120 comprises an inner surface 121, an outer surface 123, and a cylindrical body 124 comprising a first end 126, a second end 128, and a cavity 129 extending from the first end 126 to the second end 128, wherein the cavity 129 of the cylindrical body 124 is dimensioned and configured for receiving the inner bearing member 130, wherein the outer bearing member 120 is dimensioned and configured for fitting within a cavity 179 of an impeller 170 of the jet assembly 180, wherein the inner bearing member 130 comprises an inner surface 131, an outer surface 132, and a cylindrical body 134 comprising a first end 136, a second end 138, and a cavity 139 extending from the first end 136 to the second end 138 of the cylindrical body 134 of the inner bearing member 130, wherein the shaft member 150 comprises a cylindrical body 154 comprising a first end 156 and a second end 158, wherein the shaft protection member 160 comprises an inner surface 161, an outer surface 163, and a cylindrical body 164 comprising a first end 166, a second end 168, and a cavity 169 extending from the first end 166 to the second end 168 of the cylindrical body 164 of the shaft protection member 160, wherein the cavity 169 of the cylindrical body 164 of the shaft protection member 160 is dimensioned and configured for receiving the shaft member 150, wherein the shaft protection member 160 is dimensioned and configured for fitting within the cavity 139 of the cylindrical body 134 of the inner bearing member 130, and wherein the locking mechanism 159 secures or locks the shaft member 150 and shaft protection member 160 in place during operational use;

causing rotation of the impeller 170 positioned within a cavity 184 defined by the housing 181 of the jet assembly 180;

receiving the fluid through at least one input aperture 185 disposed about the housing 181 of the jet assembly 180;

disturbing the fluid with the rotating impeller 170; and outputting the fluid through at least one output aperture 186 disposed about the housing 181 of the jet assembly 180.

In addition, the method above may further include:

wherein the outer bearing member 120 further comprises a base 122 comprising a cavity, wherein the cylindrical body 124 of the outer bearing member 120 extends upwardly from the base 122, wherein the cavity of the base 122 is dimensioned and configured for receiving the inner bearing member 130, wherein the shaft member 150 further comprises a base 152, wherein the cylindrical body 154 of the shaft member 150 extends upwardly from the base 152 of the shaft member 150, and wherein the shaft protection member 160 further comprises a base 162 comprising a cavity, wherein the cylindrical body 164 of the shaft protection member 160 extends upwardly from the base 162 of the shaft protection member 160, and wherein the cavity of said base 162 is dimensioned and configured for receiving the shaft member 150.

Additionally, the method above may further include:

wherein the jet assembly 180 is adapted for being secured to a pump 300, such as a magnetic coupling-type pump 300 and the like, wherein the impeller 170 is a magnetic impeller 170 comprising a magnetic pole array 177, wherein a motor assembly 200 of the magnetic coupling-type pump 300 comprises a motor 202, a magnetic pole array 210, and a shaft member 208 adapted for being rotated such that a magnetic field 212 generated by the magnetic pole array 210 of the motor assembly 200 moves or fluctuates in accordance with the rotation of the magnetic pole array 210 of the motor assembly 200, wherein the motor 202 drives the magnetic pole array 210 of the motor assembly 200, wherein the magnetic field 212 moves and/or causes rotation of the magnetic pole array 177 of the magnetic impeller 170, and wherein rotation of the magnetic impeller 170 results in the fluid being drawn towards the magnetic impeller 170 through the at least one inlet aperture 185 and the fluid to be propelled out of the jet assembly 180 through the at least one outlet aperture 186.

Further, the method above may further include:

wherein the outer bearing member 120 is manufactured of a plastic material or engineered plastics, wherein the inner bearing member 130 is manufactured of rubber or a rubber-like material, wherein the shaft member 150 is manufactured of steel or a metal material, and wherein the shaft protection member 160 is manufactured of a hard material.

Furthermore, the method above may further include any of the parts, steps and/or details that have been described in the above paragraphs with regard to the improved bearing and shaft assembly 100, jet assemblies 180, and pumps 300, such as magnetic coupling-type pumps 300 and the like.

It is to be understood that the present invention is not limited to the embodiments described above or as shown in the attached figures, but encompasses any and all embodiments within the spirit of the invention.

What is claimed is:

1. A combination jet assembly and mounting housing member apparatus of a magnetic coupling-type fluid pump for dispensing a fluid to an environment in manicure and pedicure industries, said combination jet assembly and mounting housing member apparatus comprising:

a jet assembly comprising a bearing assembly, a shaft assembly, a magnetic impeller, and a jet assembly housing, wherein said jet assembly housing comprises an inner surface, an outer surface, a base, a front cover, an impeller-receiving chamber, at least one inlet aperture, and at least one outlet aperture, wherein said impeller-receiving chamber is defined by said base and said front cover of said jet assembly housing when said base and said front cover of said jet assembly housing are secured to one another, wherein said impeller-receiving chamber is dimensioned and configured to receive said magnetic impeller and to allow said magnetic impeller to rotate within said impeller-receiving chamber during operational use, wherein said bearing assembly comprises at least one bearing member, wherein said at least one bearing member is dimensioned and configured such that a first end of said at least one bearing member is rotated above a top surface of a base of a shaft protection member during operational use, wherein said shaft assembly comprises said shaft member and said shaft protection member, wherein said shaft member extends through said inner surface of said jet assembly housing, wherein said shaft protection member's base further comprises a bottom surface, and a diameter, wherein said base of said shaft protection member is positioned between said bearing assembly and said base of said jet assembly housing, and wherein said shaft protection member is manufactured of a hard material;

a mounting housing member comprising a top surface, a bottom surface, and a shoulder dimensioned and configured to mount to a wall of a basin in the manicure and pedicure industries, wherein said jet assembly is magnetically coupled to said top surface of said mounting housing member while a motor assembly is secured to said bottom surface of said mounting housing member; and a locking mechanism for securing said jet assembly housing to said mounting housing member to prevent rotation of said jet assembly housing during operational use.

2. The combination jet assembly and mounting housing member apparatus according to claim 1, wherein at least a portion of said at least one bearing member is manufactured of a plastic material.

3. The combination jet assembly and mounting housing member apparatus according to claim 1, wherein at least a portion of said at least one bearing member is manufactured of a rubber material that is able to absorb vibration during operational use.

4. The combination jet assembly and mounting housing member apparatus according to claim 1, wherein said shaft member is manufactured of steel or a metal material.

5. The combination jet assembly and mounting housing member apparatus according to claim 1, wherein said shaft protection member is manufactured of a ceramic material.

6. The combination jet assembly and mounting housing member apparatus according to claim 1, wherein said at least one bearing member is an outer bearing member and an inner bearing member, wherein said outer bearing member is manufactured of a plastic material, wherein said inner bearing member is manufactured of a rubber material that is able to absorb vibration during operational use, and wherein said shaft member is manufactured of steel or a metal material.

7. The combination jet assembly and mounting housing member apparatus according to claim 6, wherein said shaft protection member is manufactured of a ceramic material.

8. The combination jet assembly and mounting housing member apparatus according to claim 1, wherein said combination jet assembly and mounting housing member apparatus is adapted for being coupled to the motor assembly to form a magnetic coupling-type pump, wherein said magnetic impeller comprises a magnetic pole array, wherein said motor shaft member is adapted for being rotated such that a magnetic field generated by said magnetic pole array plate of said motor assembly moves or fluctuates in accordance with the rotation of said magnetic pole array plate of said motor assembly, wherein said motor drives said magnetic pole array plate, wherein said magnetic field moves and/or causes rotation of said magnetic pole array of said magnetic impeller, and wherein rotation of said magnetic impeller results in the fluid being drawn towards said magnetic impeller through said at least one inlet aperture and the fluid to be propelled out of said jet assembly through said at least one outlet aperture.

9. The combination jet assembly and mounting housing member apparatus according to claim 1, wherein said at least one bearing member is comprised of an outer bearing member and an inner bearing member, wherein said outer bearing member comprises a first end, a second end, and a body that comprises a first end, a second end, and a cavity extending from said first end of said body of said outer bearing member to said second end of said body of said outer bearing member, wherein said cavity of said body of said outer bearing member is dimensioned and configured for receiving said inner bearing member, and wherein said outer bearing member is dimensioned and configured for fitting within said cavity of said magnetic impeller, wherein said inner bearing member comprises a first end, a second end, and a body that comprises a first end, a second end, and a cavity extending from said first end of said body of said inner bearing member to said second end of said body of said inner bearing member, wherein said inner bearing member is dimensioned and configured for fitting within said cavity of said body of said outer bearing member and within said cavity of said magnetic impeller, and wherein said outer bearing member and said inner bearing member, when in operational use, are positioned adjacent to one another and are aligned axially with one another.

10. A magnetic coupling-type fluid pump used for dispensing a fluid to an environment in manicure and pedicure industries, said fluid pump comprising:

a motor assembly comprising a motor, a motor shaft, and a magnetic plate mounted to said motor shaft;

a jet assembly comprising a bearing assembly, a shaft assembly, a jet assembly housing and a magnetic impeller, wherein said magnetic plate and said magnetic impeller rotate on a same axis during operation, wherein said jet assembly housing comprises an inner surface, an outer surface, a base, a front cover, an impeller-receiving chamber, at least one inlet aperture and at least one outlet aperture, wherein said impeller-receiving chamber is defined by said base and said front cover of said jet assembly housing when said base and said front cover of said jet assembly housing are secured to one another, wherein said impeller-receiving chamber is dimensioned and configured to receive said magnetic impeller and to allow said magnetic impeller to rotate within said impeller-receiving chamber during operational use, wherein said bearing assembly comprises at least one bearing member, wherein said at least one bearing member is dimensioned and configured such that a first end of said at least one bearing member is rotated above a top surface of a base of a shaft protection member during operational use, wherein said shaft assembly comprises said shaft member and said shaft protection member, wherein said shaft member extends through said inner surface of said jet assembly housing, and wherein said shaft protection member's base further comprises a bottom surface, and a diameter, wherein said base of said shaft protection member is positioned between said bearing assembly and said base of said jet assembly housing, and wherein said shaft protection member is manufactured of a hard material; and a mounting housing member comprising a top surface, a bottom surface, and a shoulder dimensioned and configured to mount to a wall of a basin in the manicure and pedicure spa industries, wherein said jet assembly is magnetically coupled to said top surface of said mounting housing member while said motor assembly is secured to said bottom surface of said mounting housing member.

11. The fluid pump according to claim 10, wherein at least a portion of said at least one bearing member is manufactured of a plastic material.

12. The fluid pump according to claim 10, wherein at least a portion of said at least one bearing member is manufactured of a rubber material that is able to absorb vibration during operational use.

13. The fluid pump according to claim 10, wherein said shaft member is manufactured of steel or a metal material.

14. The fluid pump according to claim 10, wherein said shaft protection member is manufactured of a ceramic material.

15. The fluid pump according to claim 10, wherein said at least one bearing member is an outer bearing member and an inner bearing member, wherein said outer bearing member is manufactured of a plastic material, wherein said inner bearing member is manufactured of a rubber material that is able to absorb vibration during operational use, and wherein said shaft member is manufactured of steel or a metal material.

16. The fluid pump according to claim 15, wherein said shaft protection member is manufactured of a ceramic material.

17. The fluid pump according to claim 10, wherein said magnetic impeller comprises a magnetic pole array, wherein said motor assembly further comprises a magnetic pole array and a motor shaft member adapted for being rotated such that a magnetic field generated by said magnetic pole array of said motor assembly moves or fluctuates in accordance with the rotation of said magnetic pole array of said motor assembly, wherein said motor drives said magnetic pole array of said motor assembly, wherein said magnetic field moves and/or causes rotation of said magnetic pole array of said magnetic impeller, and wherein rotation of said magnetic impeller results in the fluid being drawn towards said magnetic impeller through said at least one inlet aperture and the fluid to be propelled out of said jet assembly through said at least one outlet aperture.

18. The fluid pump according to claim 10, wherein said at least one bearing member is comprised of an outer bearing member and an inner bearing member, wherein said outer bearing member comprises a first end, a second end, and a body that comprises a first end, a second end, and a cavity extending from said first end of said body of said outer bearing member to said second end of said body of said outer bearing member, wherein said cavity of said body of said body of said outer bearing member is dimensioned and configured for receiving said inner bearing member, and wherein said outer bearing member is dimensioned and configured for fitting within said cavity of said magnetic impeller, wherein said inner bearing member comprises a first end, a second end, and a body that comprises a first end, a second end, and a cavity extending from said first end of said body of said inner bearing member to said second end of said body of said inner bearing member, wherein said inner bearing member is dimensioned and configured for fitting within said cavity of said body of said outer bearing member and within said cavity of said magnetic impeller, and wherein said outer bearing member and said inner bearing member, when in operational use, are positioned adjacent to one another and are aligned axially with one another.

19. The combination jet assembly and mounting housing member apparatus according to claim 1, wherein said diameter of said base of said shaft protection member is larger than or equal to an outer diameter of said at least one bearing member.

20. The combination jet assembly and mounting housing member apparatus according to claim 1, wherein said shaft protection member further comprises a body extending upwardly from said base of said shaft protection member, wherein said body of said shaft protection member comprises a first end, a second end, and a cavity extending from said first end to said second end of said body of said shaft protection member, wherein said cavity of said body of said shaft protection member is dimensioned and configured for receiving said body of said shaft member, and wherein said body of said shaft protection member is dimensioned and configured for fitting within said cavity of said at least one bearing member.

21. The combination jet assembly and mounting housing member apparatus according to claim 20, wherein at least a portion of said at least one bearing member is manufactured of a rubber material that is able to absorb vibration during operational use.

22. The combination jet assembly and mounting housing member apparatus according to claim 1, wherein said mounting housing member further comprises at least one mounting leg.

23. The combination jet assembly and mounting housing member apparatus according to claim 22, wherein said at least one mounting leg is dimensioned and configured for receiving a wing nut.

24. The combination jet assembly and mounting housing member apparatus according to claim 20, further comprising a locking mechanism for locking said shaft protection member and said shaft member in place during operational use.

25. The fluid pump according to claim 10, wherein said base of said shaft protection member makes contact with said first end of said at least one bearing member during operational use.

26. A combination jet assembly and mounting housing member apparatus of a magnetic coupling-type fluid pump used for dispensing a fluid to an environment in manicure and pedicure industries, said combination jet assembly and mounting housing member apparatus comprising:

a jet assembly comprising a bearing assembly, a shaft assembly, a jet assembly housing, and a magnetic impeller, wherein said jet assembly housing comprising an inner surface, an outer surface, a base, a front cover, an impeller-receiving chamber, at least one inlet aperture, and at least one outlet aperture, wherein said impeller-receiving chamber is defined by said base and said front cover of said jet assembly housing when said base and said front cover of said jet assembly housing are secured to one another, wherein said impeller-receiving chamber is dimensioned and configured to receive said magnetic impeller and to allow said magnetic impeller to rotate within said impeller-receiving chamber during operational use, wherein said bearing assembly comprises an outer bearing member and an inner bearing member, wherein said outer bearing member has a diameter and is dimensioned and configured such that a first end of said outer bearing member is rotated above a top surface of a base of a shaft protection member during operational use, wherein said inner bearing member is manufactured of a rubber material that is able to absorb vibration during operational use, wherein said shaft assembly comprises said shaft member and a shaft protection member, wherein said shaft member extends through an inner surface of a base of said jet assembly housing, wherein said shaft protection member's base further comprises a bottom surface, and a diameter, and wherein said base of said shaft protection member is positioned between said bearing assembly and said base of said jet assembly housing, wherein said shaft protection member is manufactured of a hard material, and wherein said diameter of said base of said shaft protection member is greater than or equal to said diameter of said outer bearing member; and a mounting housing member comprising a top surface, a bottom surface, and a shoulder dimensioned and configured to mount to a wall of a basin in the manicure and pedicure industries, wherein said jet assembly is magnetically coupled to said top surface of said mounting housing member while a motor assembly is secured to said bottom surface of said mounting housing member.

27. The combination jet assembly and mounting housing member apparatus according to claim 26, wherein said shaft protection member further comprises a body comprising a first end, a second end, and a cavity extending from said first end to said second end of said body of said shaft protection member, wherein said body of said shaft protection member extends upwardly from said base of said shaft protection member, wherein said cavity of said body of said shaft protection member is dimensioned and configured for receiving said body of said shaft member, and wherein said body of said shaft protection member is dimensioned and configured for fitting within said cavity of said inner bearing member, said cavity of said outer bearing member, and said cavity of said magnetic impeller, and wherein, when in operational use, said body of said outer bearing member, said body of said inner bearing member, said body of said shaft protection member, and said body of said shaft member are all positioned within said cavity of said magnetic impeller.

28. The combination jet assembly and mounting housing member apparatus according to claim 26, wherein said shaft protection member is manufactured of a ceramic material.

29. The combination jet assembly and mounting housing member apparatus according to claim 26, wherein said shaft member is manufactured of steel or a metal material.

30. The combination jet assembly and mounting housing member apparatus according to claim 26, wherein said base of said shaft protection member makes contact with said first end of said outer bearing member during operational use.

* * * * *